US010221594B2

(12) United States Patent
Raffi et al.

(10) Patent No.: US 10,221,594 B2
(45) Date of Patent: Mar. 5, 2019

(54) CABINET LOCK

(71) Applicant: Dorel Juvenile Group, Inc., Foxboro, MA (US)

(72) Inventors: Laura Kay Raffi, Holliston, MA (US); Kevin V Maloney, North Kingstown, RI (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 384 days.

(21) Appl. No.: 15/045,780

(22) Filed: Feb. 17, 2016

(65) Prior Publication Data

US 2016/0237725 A1 Aug. 18, 2016

Related U.S. Application Data

(60) Provisional application No. 62/116,960, filed on Feb. 17, 2015.

(51) Int. Cl.

| | |
|---|---|
| ***E05C 7/04*** | (2006.01) |
| ***E05B 15/00*** | (2006.01) |
| ***E05B 65/44*** | (2006.01) |
| *E05C 19/18* | (2006.01) |

(52) U.S. Cl.

CPC ..... *E05C 7/04* (2013.01); *E05B 15/0046* (2013.01); *E05B 65/44* (2013.01); *E05C 19/186* (2013.01); *Y10S 292/37* (2013.01); *Y10T 292/228* (2015.04); *Y10T 292/28* (2015.04); *Y10T 292/34* (2015.04)

(58) Field of Classification Search

CPC ..... E05B 13/002; E05B 15/0046; E05B 65/0014; E05B 65/44; E05C 19/003; E05C 19/18; E05C 19/186; E05C 19/188; Y10S 292/37; Y10T 292/28; Y10T 292/34; Y10T 292/37; Y10T 292/67; Y10T 292/228

USPC ..... 70/14, 18, 19, 57.1, 78

See application file for complete search history.

(56) References Cited

U.S. PATENT DOCUMENTS

| | | | | | |
|---|---|---|---|---|---|
| 390,130 | A * | 9/1888 | Longenecker | E05C 19/182 | 292/292 |
| 765,658 | A * | 7/1904 | Beseler | E05C 19/18 | 292/258 |
| 801,369 | A * | 10/1905 | Dickson | E05C 19/182 | 292/295 |
| 827,624 | A * | 7/1906 | Foster | E05C 19/18 | 292/288 |
| 1,700,045 | A * | 1/1929 | Hampton | E05B 13/04 | 70/430 |
| 2,963,895 | A * | 12/1960 | Thomas | E05B 67/383 | 292/288 |

(Continued)

FOREIGN PATENT DOCUMENTS

| | | | | |
|---|---|---|---|---|
| FR | 2698904 A1 | * | 6/1994 | E05C 19/186 |
| WO | WO 2011131971 | * | 10/2011 | |

OTHER PUBLICATIONS

Safety 1st Cabinet Slide Lock User Guide (2012), 1 page.

*Primary Examiner* — Carlos Lugo

(74) *Attorney, Agent, or Firm* — Barnes & Thornburg LLP

(57) ABSTRACT

A cabinet lock includes a first knob mount and a separate second knob mount. The first knob mount is arranged to mate with a doorknob carried on a first cabinet door. The second knob mount is arranged to mate with a doorknob carried on the second cabinet door to retain the first and second cabinet doors in closed positions.

19 Claims, 8 Drawing Sheets

(56) References Cited

U.S. PATENT DOCUMENTS

| | | | | | |
|---|---|---|---|---|---|
| 3,451,708 | A * | 6/1969 | Brooks | E05C 17/365 | 292/264 |
| 3,664,164 | A * | 5/1972 | Zaidener | B60R 25/0221 | 70/202 |
| 4,089,551 | A * | 5/1978 | Perreira | B65D 55/02 | 292/246 |
| 5,387,018 | A * | 2/1995 | Pinkerton | E05B 15/1607 | 292/106 |
| 5,462,323 | A * | 10/1995 | Benninger | B60J 1/1853 | 292/266 |
| 5,501,493 | A * | 3/1996 | Arthur | E05C 19/18 | 292/258 |
| 5,544,505 | A * | 8/1996 | McIntosh | E05B 67/383 | 70/14 |
| 6,182,485 | B1 * | 2/2001 | Moore | E05B 13/002 | 292/258 |
| 6,709,034 | B2 * | 3/2004 | Michael | E05B 65/0864 | 292/150 |
| 7,121,124 | B1 * | 10/2006 | Whinery | E05B 67/24 | 70/38 C |
| 8,313,128 | B2 * | 11/2012 | Belyea | E05B 13/00 | 292/258 |
| 8,851,535 | B2 * | 10/2014 | Miskel | E05C 19/186 | 292/258 |

* cited by examiner

ROTATE TO SPAN GAP
MOUNT ON HANDGRIP
SLIDE TO LOCK
PIVOT TO CAPTURE HANDGRIP
MOVABLE FRAME RETAINER
SLIDE
PIVOT
FRAME-RETAINER PIVOT AXIS
FRAME
CABINET LOCK
See Fig. 12

CABINET LOCK

PRIORITY CLAIM

This application claims priority under 35 U.S.C. § 119(e) to U.S. Provisional Application No. 62/116,960, filed Feb. 17, 2015, which is expressly incorporated by reference herein.

BACKGROUND

The present disclosure relates to a lock, and in particular a lock for a cabinet. More particularly, the present disclosure relates to a cabinet lock for locking two adjacent doors by mating with existing cabinet door hardware.

SUMMARY

A cabinet lock in accordance with the present disclosure indicates a first handgrip mount for mating with a first handgrip carried on one cabinet door and a second handgrip mount for mating with a second handgrip carried on an adjacent cabinet door. In illustrative embodiments, the second handgrip mount is movable relative to the first handgrip mount under the control of a caregiver during installation of the cabinet lock on the first and second handgrip mounts and removal of the cabinet lock from the handgrip mounts.

In illustrative embodiments, the cabinet lock includes a cane-shaped frame configured to be mounted by a caregiver in any suitable manner on a first handgrip on a first cabinet door on a cabinet. The cabinet lock also includes a movable frame retainer that is configured to be mated with a second handgrip on an adjacent second cabinet door of the cabinet. The movable frame retainer is configured to slide back and forth in a guide slot formed in a ratchet arm included in the frame and, if necessary (when the second handgrip is relatively far away from the first handgrip), pivot relative to the ratchet arm about a pivot axis to mate with the second handgrip after the movable frame retainer has been moved by a caregiver to a free end of the ratchet arm. Movement of either cabinet door relative to a cabinet base on which the doors are mounted to an opened position is blocked by the cabinet lock when the frame is coupled to the first handgrip and the movable frame member is coupled to the second handgrip.

In illustrative embodiments, the cabinet lock also includes a detent system of any suitable design that is operable by the caregiver to retain the movable frame retainer in a selected position relative to the frame while the frame is mounted on the first handgrip and the frame retainer is mounted on the second handgrip to lock the cabinet doors in closed positions on a cabinet base. The detent system includes a spring-based, tooth-engaging anchor that is arranged normally to engage the underlying ratchet teeth included in the ratchet arm to retain the movable frame retainer in a position on the ratchet arm of the frame that has been selected by a caregiver. The detent system also includes a slidable lock-release tab that can be moved by a caregiver relative to the frame retainer to move the anchor to disengage the ratchet teeth on the ratchet arm to free the frame retainer so that it can be moved relative to the ratchet arm by the caregiver.

In illustrative embodiments, the frame includes a closed-loop handgrip mount coupled to the first handgrip and a ratchet arm cantilevered to the closed-loop handgrip mount. The movable frame retainer includes a C-shaped handgrip mount configured to be coupled to the second handgrip and a guide comprising a first guide pin that is coupled to the C-shaped handgrip mount and sized and shaped to slide in a guide channel formed in the ratchet arm and arranged to extend along the length of the ratchet arm from the closed-loop handgrip mount to a free end of the ratchet arm.

In the illustrative embodiments, the C-shaped handgrip mount is configured to pivot about a horizontal pivot axis that is generally perpendicular to the ratchet arm when the guide has been moved in the guide channel to the free end of the ratchet arm so that the movable frame retainer is free to pivot around the second handgrip and then slide toward the first handgrip to be mounted on the second handgrip. The first guide pin is free to pivot in the guide channel formed in the ratchet arm when the C-shaped handgrip mount has been slid by a caregiver to the free end of the ratchet arm.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 14 is a perspective view of a pair of sliding doors that are separated from one another and showing the cabinet lock in an orientation similar to that shown in FIG. 3 in which the ratchet arm of the frame lies above a right door handle while the closed-loop handgrip mount of the frame is mounted on a left door handle;

FIG. 15 is a view similar to FIG. 14 showing that the C-shaped handgrip mount of the frame retainer has been pivoted downwardly on the first and second guide pins by a caregiver about the frame-retainer pivot axis and then slid to the left on the ratchet arm to cause a portion of the right door handle to extend into the handgrip-receiving channel formed in the C-shaped handgrip mount; and FIG. 16 is an enlarged perspective view similar to FIGS. 14 and 15 showing that a caregiver has slid the cabinet doors toward one another until they nearly touch and showing that the detent system has been operated by the caregiver to free the C-shaped handgrip mount of the movable frame retainer to move along the ratchet arm toward the closed-loop handgrip mount of the frame as the cabinet doors are drawn together by the caregiver.

DETAILED DESCRIPTION

Figures 1, 2, 3, 4:
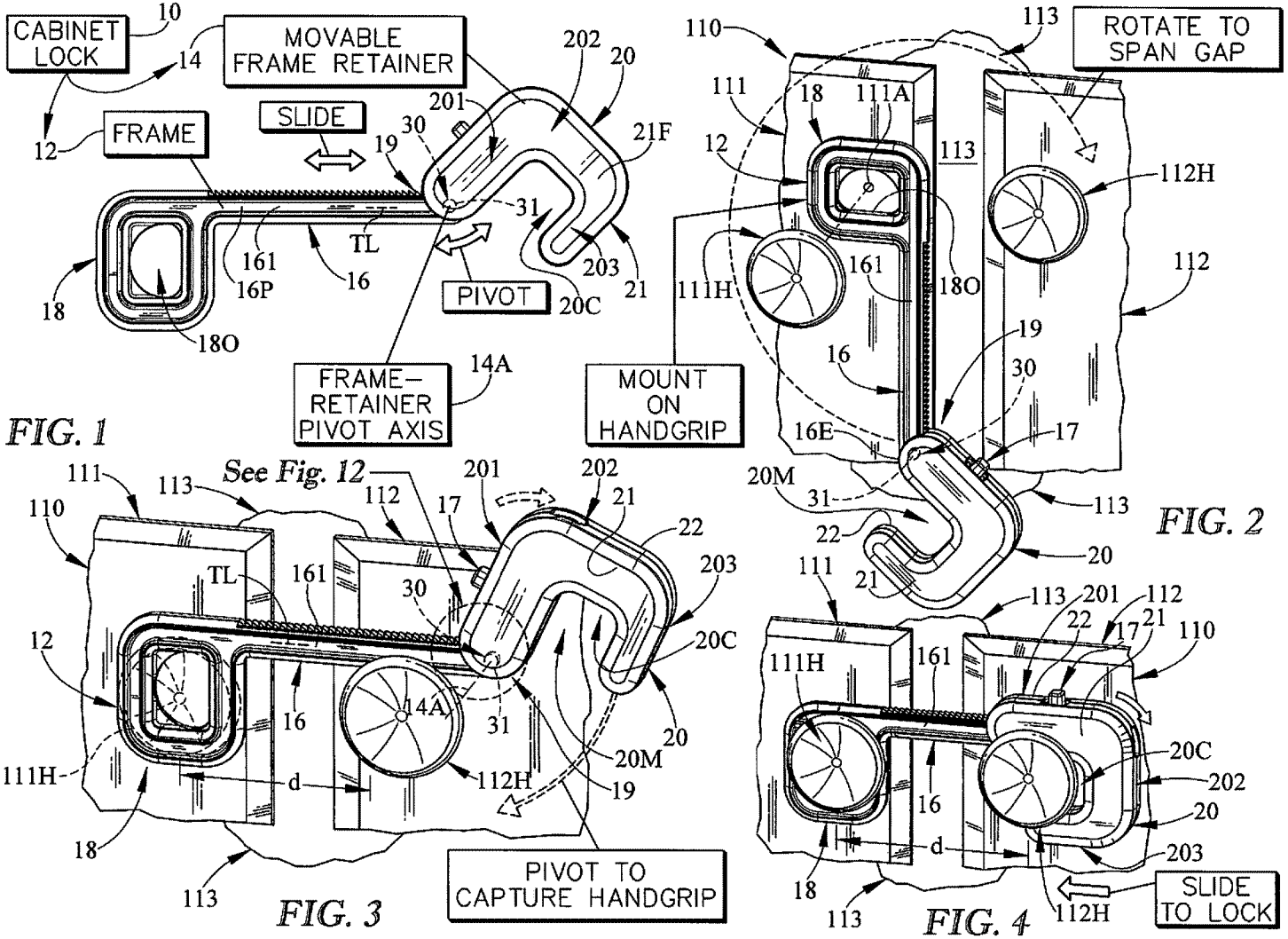
FIG. 1 is a front elevation view of a cabinet lock in accordance with the present disclosure showing that the cabinet lock includes a frame configured to be mounted on existing cabinet hardware such as a first cabinet-door handgrip and a movable frame retainer that is configured to slide back and forth in a guide slot formed in the frame during coupling and uncoupling of the movable frame retainer to and from an adjacent second cabinet-door handgrip and showing that the frame includes a closed-loop handgrip mount and a ratchet arm coupled at one end to the handgrip mount and formed to include the guide slot and the movable frame retainer includes a C-shaped handgrip mount and a guide coupled to the C-shaped handgrip mount to move therewith and arranged to extend into the guide slot to support the C-shaped handgrip mount of the movable frame retainer for sliding and pivoting movement relative to the frame as suggested in FIGS. 2-4 and 11-16.
FIG. 2 is a perspective view of the cabinet lock of FIG. 1 after the closed-loop handgrip mount of the frame has been coupled to a first cabinet-door handgrip to allow the ratchet arm to hang downwardly to allow the cabinet lock to assume an opened position when not in use and showing that the C-shaped handgrip mount of the movable frame retainer is hanging from the free end of the ratchet arm owing to downward sliding and pivoting movement of the guide that is coupled to the C-shaped handgrip mount in the guide slot formed in the ratchet arm.
FIG. 3 is a perspective view similar to FIG. 2 showing that a caregiver has pivoted the frame in a clockwise direction through an angle of about 270° to place the ratchet arm above an adjacent second cabinet-door handgrip and suggesting that the caregiver can pivot the C-shaped handgrip mount of the movable frame retainer about the frame-retainer pivot axis established by the guide in a clockwise direction when the frame-retainer pivot axis is located at the free end of the ratchet arm to cause the open mouth of the C-shaped handgrip mount to face toward and lie in spaced-apart relation to the second cabinet-door handgrip.
FIG. 4 is a perspective view similar to FIG. 3 after the caregiver has slid the movable frame retainer on the ratchet arm to the left toward the second cabinet-door handgrip to cause the second cabinet-door handgrip to pass through the open mouth and extend into a handgrip-receiving channel formed in the C-shaped handgrip mount and suggesting that a detent system included inside the movable frame retainer mates with ratchet teeth included in the ratchet arm to anchor the movable frame retainer in a stationary position on the frame to block any substantial movement of the second cabinet-door handgrip and its cabinet door relative to the first cabinet-door handgrip and its cabinet door.

A cabinet lock 10 in accordance with the present disclosure can be used as suggested in FIGS. 2-4 to lock cabinet doors 111, 112 of a cabinet 110 in closed positions on a cabinet base 113 of cabinet 110 as suggested in FIGS. 2-4. Cabinet lock 10 includes a cane-shaped frame 12 and a movable frame retainer 14 that is configured as suggested in FIG. 1 to slide back and forth along a ratchet arm 16 included in the cane-shaped frame 12 and, when the movable frame retainer 14 has been slid by a caregiver to a free end 16E of ratchet arm 16, to pivot about a horizontal frame-retainer pivot axis 14A that is perpendicular to ratchet arm 16. Cabinet lock 10 can be installed by a caregiver on a variety of cabinets as suggested in FIGS. 2-4 and 14-16.

A closed-loop handgrip mount 18 included in the cane-shaped frame 12 of cabinet lock 10 and coupled to one end of ratchet arm 16 can be mounted on existing cabinet hardware such as a first handgrip 111H that has been removed from first cabinet door 111. Then first handgrip 111H is mounted on first cabinet door 111 while the closed-loop handgrip mount 118 remains coupled to the first handgrip 111H.

Next a C-shaped handgrip mount 20 included in the movable frame retainer 14 of cabinet lock 10 can be arranged by a caregiver to mount on a companion second handgrip 112H that is coupled to an adjacent second cabinet door 112 following any needed sliding and pivoting motion of the movable frame retainer 14 relative to the cane-shaped frame 12 as suggested, for example, in FIGS. 2-4. If the handgrips 111H, 112H are close enough together when cabinet doors 111, 112 are closed then only sliding motion may be needed to cause the C-shaped handgrip mount 20 in the movable frame retainer 14 to mount on second handgrip 112H. However, if the distance "d" between the handgrips 111H, 112H is relatively large as compared to the length of ratchet arm 16, then the caregiver can slide the C-shaped retainer mount all the way to the free-end 16 of ratchet arm 16 as suggested in FIG. 3 and then pivot the C-shaped retainer mount 20 about the frame-retainer pivot axis 16A to CLEAR the second handgrip 112H so that C-shaped retainer mount 20 can then be mounted on the second handgrip 112H.

A detent system 17 is also included in cabinet lock 10 and coupled to the movable frame retainer 14 to slide and pivot therewith relative to ratchet arm 16 of frame 12 as suggested in FIGS. 1-4, 5, 6, 6A, 6B, and 7-11. Detent system 17 is configured to provide means operable by a caregiver for selectively anchoring the movable frame retainer 14 in a stationary position on ratchet arm 16 to retain C-shaped handgrip mount 20 in a selected stationary position relative to closed-loop handgrip mount 10 as suggested in FIGS. 3 and 4.

Figure 5:
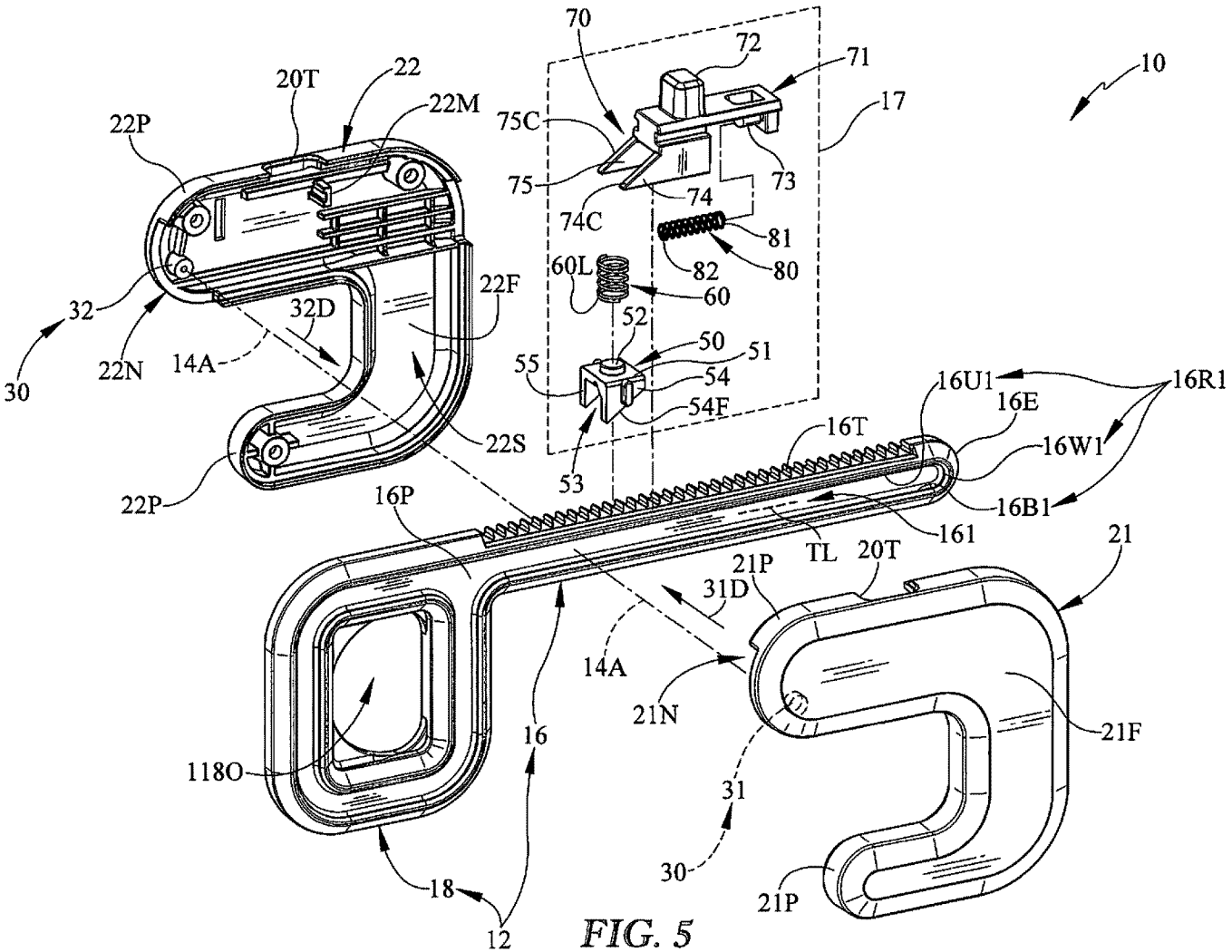
FIG. 5 is an exploded perspective assembly view of the cabinet lock of FIGS. 1-4 showing that the frame includes a ratchet arm cantilevered to a closed-loop handgrip mount that is formed to receive a D-shaped handgrip-receiving aperture, the C-shaped handgrip mount of the movable frame retainer includes a C-shaped first shell in the foreground, a companion C-shaped second shell in the background, and the guide includes a first guide pin appended to the first shell and arranged to extend toward a first guide slot formed in a near side of the ratchet arm and a second guide pin appended to the second shell and arranged to extend toward a second guide slot (unseen in FIG. 5 but seen in FIG. 6) formed in a far side of the ratchet arm and toward the first guide pin, and also showing components included in the detent system housed in an interior region formed between the first and second shells to engage ratchet teeth included in the ratchet arm to anchor the movable frame retainer in one of the several stationary positions along the length of the ratchet arm at the option of the caregiver to control the side-to-side relative spacing between the closed-loop and C-shaped handgrip mounts.
Figure 13:
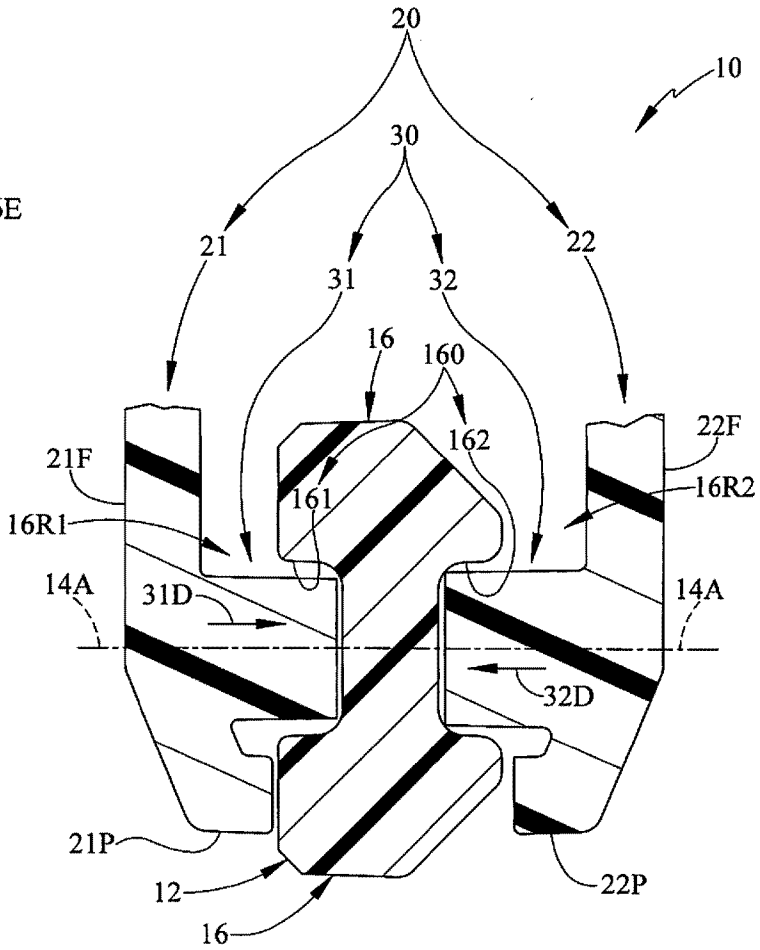
FIG. 13 is an enlarged sectional view taken along line 13-13 of FIG. 12 showing that the guide channel formed in the ratchet arm is defined by a first guide slat formed in a left-side portion of the ratchet arm and a second guide slot formed in a right-side portion of the ratchet arm and the first guide pin of the guide is arranged to extend into the first guide slot on one side of the ratchet and the second guide pin of the guide is arranged to extend toward the first guide pin and into the second guide slot and showing the frame-retainer pivot axis established by the first and second guide pins of the guide.

A first guide slot 161 is formed in a first side of ratchet arm 16 and sized to receive a companion first guide pin 31 that is coupled to C-shaped handgrip mount 20 as suggested in FIGS. 1, 5, and 13. First guide pin 31 travels back and forth in first guide slot 161 as movable frame retainer 14 slides back and forth on ratchet arm 16 of the cane-shaped frame 12 as suggested in FIGS. 9 and 11. First guide pin 31 can also pivot in first guide slot 161 about a frame-retainer pivot axis 14A established by the first guide pin 161 once first guide pin 31 has been moved to the free-end 16E of ratchet arm 16 as suggested in FIG. 3. Owing to such freedom of movement (i.e., sliding and pivoting) the movable frame retainer 14 can be slid by a caregiver to the free end 16E of the ratchet arm 16 and then pivoted about frame-retainer pivot axis 14A at that point in order to allow cabinet lock 10 to fit around handgrips (e.g., knobs or handles) that span a greater separation distance as suggested in FIG. 3 as compared to a lesser separation distance (not shown).

Figure 6:
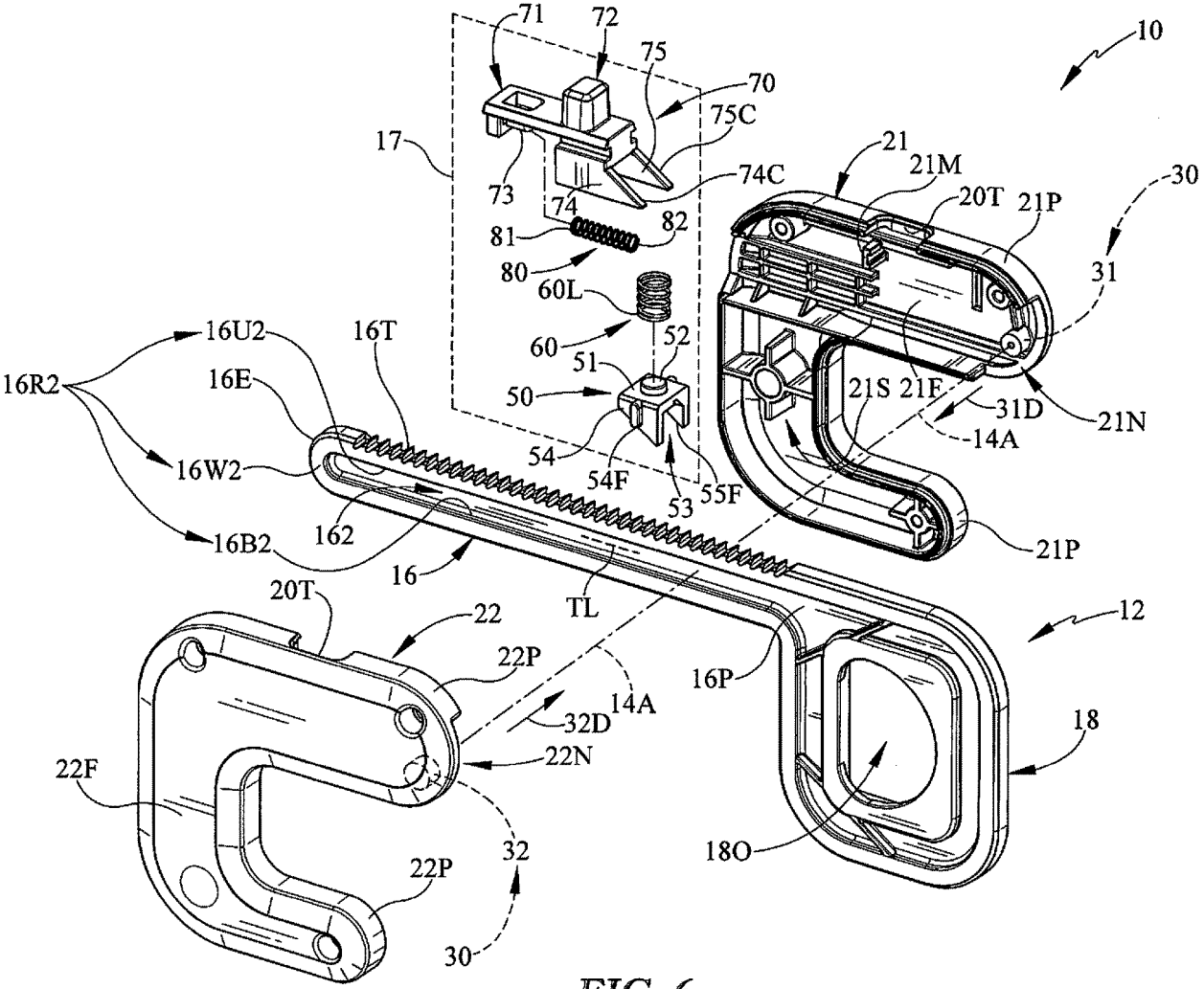
FIG. 6 is a view similar to FIG. 5 taken from a different point of view.
Figure 12:
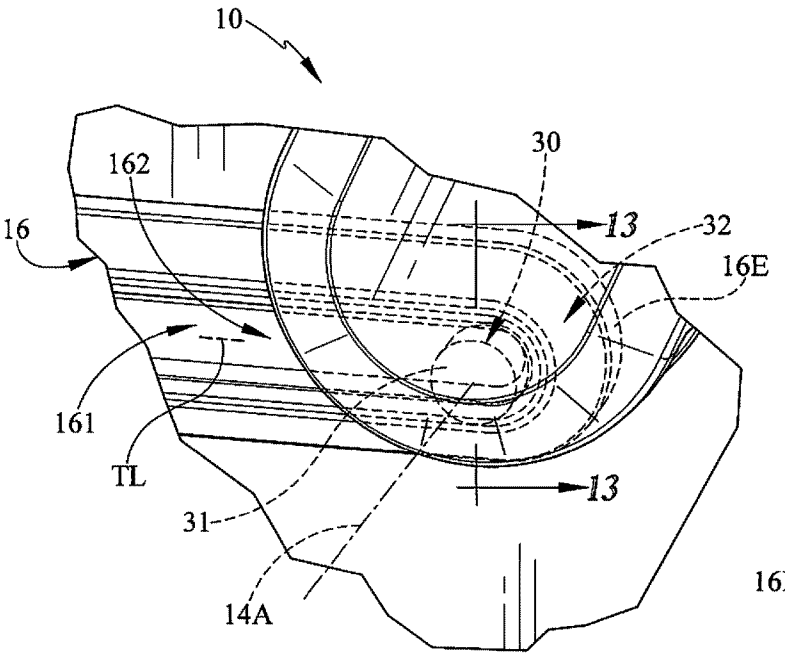
FIG. 12 is an enlarged view taken from the circled region of FIG. 1 showing that the first guide pin of the guide is the free-end position in the first guide slot formed in the ratchet arm of the frame.

A second guide slot 162 is formed in an opposite second side of ratchet arm 16 and sized to receive a second guide pin 32 that is coupled to C-shaped handgrip mount 20 as suggested in FIGS. 6 and 13. Second guide pin 32 is arranged to lie in coaxial relation to first guide pin 31 as suggested in FIG. 13. Second guide pin 32 travels back and forth in second guide slot 162 as movable fame retainer 14 slides back and forth on ratchet arm 16 of the cane-shaped frame 12 as first guide pin 31 travels back and forth in first guide slot 161. Second guide pin 32 can also pivot in second guide slot 162 once second guide pin 32 has been moved (along with first guide pin 31) to the free end 16E of ratchet arm 16 as suggested in FIG. 12. The movable frame retainer 14 can be pivoted by a caregiver about frame-retainer pivot axis 14A once first and second guide pins 31, 32 are moved in their respective guide slots 161, 162 to reach free end 16E of ratchet arm 16.

Installation of cabinet lock 10 on a cabinet 110 to lock cabinet doors 11, 12 is shown, for example, in FIGS. 2-4. In use, closed-loop handgrip mount 10 of frame 12 is mounted on existing cabinet hardware such as first handgrip 11H of first cabinet door 11 using any suitable technique. Then frame 12 is pivoted by a caregiver about a first-handgrip pivot axis 11HA as suggested in FIG. 12 to cause ratchet arm 16 to lie above second handgrip 12H and frame-retainer 20 is pivoted about frame-retainer pivot axis 14A at the free end 16E of ratchet arm 16 to cause the C-shaped handgrip mount 20 to pivot about frame-retainer pivot axis 14A as suggested in FIG. 3. Then frame retainer 14 slid by a caregiver to the left as needed along ratchet arm 16 toward closed-loop handgrip mount 18 to lock handgrips 11H, 12H and their companion cabinet doors 11,12 in a closed position on a cabinet base 13 as suggested in FIG. 4.

Ratchet arm 16 of cane-shaped frame 12 is formed to include a first guide slot 161 formed on one side thereof as shown in FIG. 5 and a second guide slot 162 found on an opposite side thereof as shown in FIG. 6. Each of first and second guide slots 161, 162 extends from closed-loop handgrip mount 18 to free end 16E of ratchet arm 16. Guide slots 161, 162 cooperate to define the guide channel 160 of ratchet arm 16 as suggested in FIG. 13.

A series of ratchet teeth 16T are provided along a top edge of ratchet arm 16 as suggested in FIGS. 5 and 6. These ratchet teeth 16T are sized and shaped to be engaged by lock teeth 53 included in the detent system 17 that is carried inside the movable frame retainer 20 and is operable by a caregiver to anchor frame retainer 20 in a selected position on ratchet arm 16 of frame 12 to retain cabinet lock 10 in a cabinet-locking position on cabinet 110 as suggested in FIGS. 7 and 8.

Closed-loop handgrip mount 18 of cane-shaped frame 12 is coupled to a proximal end 16P of ratchet arm 16 as suggested in FIGS. 5 and 6. In illustrative embodiments, handgrip mount 18 has a closed-loop shape so that cabinet lock 10 will stay attached to first handgrip 111H when not in use. As suggested in FIGS. 2 and 3, first handgrip 111H can be removed from first cabinet door 111 and then handgrip mount 18 can be centered around a handgrip mounting aperture 111A and then first handgrip 111H can be attached to first cabinet door 111 so that the first handgrip 111H extends through an opening 18O formed in closed-loop handgrip mount 18.

C-shaped handgrip mount 20 of the movable frame retainer 14 includes separate first and second C-shaped shells 21, 22 as suggested in FIGS. 5 and 6. Each shell 21, 22 is formed to include a hollow space 21S, 22S as shown for example, in FIGS. 5 and 6. Shell 21, 22 are mated together to locate detent system 17 and a portion of ratchet arm 16 therebetween.

First C-shaped shell 21 is formed to include an arm-receiving notch 21N aligned in close proximity to first guide pin 31 as suggested in FIGS. 5 and 6. Notch 21N is sized and shaped to receive a portion of ratchet arm 16 therein during pivoting movement of first C-shaped shell 21 of C-shaped handgrip mount 20 relative to ratchet arm 16 about frame-retainer pivot axis 14A as suggested in FIGS. 3, 4, and 11. In illustrative embodiments, arm-receiving notch 21N is formed in a perimeter wall 21P of first C-shaped shell 21 while first guide pin 31 is appended to a front wall 21F of first C-shaped shell 21 that has a perimeter edge that is coupled to perimeter wall 21P as suggested in FIGS. 5 and 6 to form hollow space 21S.

Second C-shaped shell 22 is formed to include an arm-receiving notch 22N aligned in close proximity to second guide pin 32 as suggested in FIGS. 5 and 6. Notch 22N is sized and shaped to receive a portion of ratchet arm 16 therein during pivoting movement of second C-shaped shell 22 of C-shaped handgrip mount 20 relative to ratchet arm 16 about frame-retainer pivot axis 14 as suggested in FIGS. 3, 4, and 11. In illustrative embodiments, arm-receiving notch 22N is formed in a perimeter wall 21P of second C-shaped shell 22 while second guide pin 32 is appended to a front wall 22F of second C-shaped shell 22 that has a perimeter edge that is coupled to perimeter wall 22P as suggested in FIGS. 5 and 6 to form hollow space 22S.

Guide 30 of the movable frame retainer 14 includes first and second guide pins 31, 32 as suggested in FIGS. 5, 6, and 13. First guide pin 31 is coupled to the first C-shaped shell 21 to slide and pivot in first guide slot 161 formed in a first side of ratchet arm 16 of frame 12. Second guide pin 32 is coupled to the second C-shaped shell 22 to slide and pivot in second guide slot 162 formed in an opposite second side of ratchet arm 16 of frame 12. First and second guide pins 31, 32 cooperate to form a guide 30 that is configured to provide means for traveling in a guide channel 160 (e.g., guide slots 161, 162) formed in ratchet arm 16 of frame 12 to allow independent sliding motion of frame retainer 14 back and forth along ratchet arm 16 and pivoting motion of frame retainer 14 about frame-retainer pivot axis 14A at, for example, free-end 16E of ratchet arm 16.

Detent system 17 is configured to provide means for selectively engaging one or more of the ratchet teeth 16T included in ratchet arm 16 of the cane-shaped frame 12 to retain the C-shaped handgrip mount 20 of frame retainer 14 in a selected position on ratchet arm 16 relative to the closed-loop handgrip mount 18 as suggested in FIGS. 3 and 4. In illustrative embodiments, detent system 17 includes a tooth-engaging anchor 50, an anchor-biasing spring 60, and anchor mover 70 having a lock-release tab 72, and a mover-biasing spring 80 as shown in FIGS. 5 and 6.

Tooth-engaging anchor 50 of detent system 17 is configured to engage one or more ratchet teeth 16T included in ratchet arm 16 to block sliding movement of frame retainer 14 back and forth along ratchet arm 16. Anchor 50 includes a horizontal platform 51, a post 52 coupled to a topside of platform 51 and arrange to mate with a lower end 60L of anchor-biasing spring 60, and at least one lock tooth 53 coupled to an underside of platform 51 and arranged to engage ratchet teeth 16T included in ratchet arm 16. Anchor 50 also includes first and second side walls 54, 55 depending from platform 51 as suggested in FIG. 5 and lying in spaced-apart relation to locate lock tooth 53 therebetween. Downwardly facing cam-follower 55F, 55F of side walls are angled to provide cam-follower means for engaging angled cam ramps 74C, 75C provided in anchor mover 70 during back-and-forth sliding movement of another mover 70 relative to C-shaped handgrip mount 20 to change the elevation of tooth-engaging anchor 50, as suggested in FIGS. 7-10.

Anchor mover 70 includes a slider 71, an upstanding lock-release tab 72 coupled to a topside of slider 71, and a spring mount 73 coupled to slider 71 and arranged to engage one end of mover-biasing spring 80 as shown in FIGS. 5 and 6. Anchor mover 70 also includes first and second side walls 74, 75 depending from slider 71 and arranged to align and mate with first and second side walls 54, 55 of tooth-engaging anchor 50. Upwardly-facing cam ramps 74C, 75C are angled and engage downwardly facing cam-follower edges 54F, 55F of anchor 50 to convert sliding horizontal movement of anchor mover 70 into up-or-down vertical movement of anchor 50 relative to C-shaped handgrip mount 20 as suggested in FIGS. 7-10.

Anchor-biasing spring 60 has an upper end 60U engaged to an underside of slider 71 of anchor mover 70 and a lower end 60L engaged to the underlying tooth-engaging anchor 50 as suggested in FIGS. 5 and 6. Spring 60 is configured provide means for yieldably biasing the tooth-engaging anchor 50 downwardly to cause lock tooth 53 to engage one of the ratchet teeth 16T included in the ratchet arm 16. Anchor-biasing spring 60 is a compression spring positioned to lie between the topside of platform 51 and the underside of slider 71.

Mover-biasing spring 80 has a first and 81 coupled to spring mounted 73 of anchor mover 70 and an opposite second and 82 coupled to a spring mount 21M in first shell 21 (and/or a spring mount 22M in second shell 22) as suggested in FIGS. 5 and 6. Mover-biasing spring 80 is a compression spring in an illustrative embodiment.

First shell 21 and second shell 22 cooperate to form a top opening 20T as suggested in FIGS. 5 and 6. Anchor mover 70 is arranged to move in the interior region 21S, 22S formed in C-shaped handgrip to cause lock-release tab 72 to extend upwardly through top opening 20T as suggested in FIGS. 1-4 and 7-11 to provide a caregiver with means for gripping and moving slider 71 in the interior region 21S, 22S of C-shaped handgrip mount 20 to cause upward movement of tooth-engaging anchor 50 to disengage ratchet teeth 16T of ratchet arm 16 as suggested in FIGS. 9 and 10. Such disengagement frees frame retainer 14 to be moved by the caregiver relative to the ratchet arm 16 of frame 12.

As suggested in FIG. 2, closed-loop handgrip mount 18 of frame 12 has been coupled to a first cabinet-door handgrip 111H by a caregiver to allow ratchet arm 16 to hang downwardly to allow cabinet lock 10 to assume an opened position when not in use. The C-shaped handgrip mount 20 of the movable frame retainer 14 is arranged to hang from the free end 16E of ratchet arm 16 following downward sliding and pivoting movement of the guide 30 (e.g., guide pins 31, 32) that is coupled to the C-shaped handgrip mount 20 in the guide channel 160 (e.g., guide slots 161, 162) formed in the ratchet arm.

The caregiver can then pivot the frame 12 in a clockwise direction through an angle of about 270° as suggested in FIGS. 2 and 3 to place ratchet arm 16 above an adjacent second cabinet-door handgrip 112H. The caregiver can next pivot the C-shaped handgrip mount 20 of the movable frame retainer 14 about a frame-retainer pivot axis 14A established by guide 30 in a clockwise direction when the frame-retainer pivot axis 14A is located at the free end 16E of ratchet arm 16 to cause open mouth 20M of the C-shaped handgrip mount 20 to face toward and lie in spaced-apart relation to the second cabinet-door handgrip 112H as suggested in FIGS. 3 and 4.

Finally, the caregiver slides the movable frame retainer 14 on ratchet arm 16 to the left toward the second cabinet-door handgrip 112H to cause the second cabinet-door handgrip 112H to pass through open mouth 20M extend into a handgrip-receiving channel 20C formed in the C-shaped handgrip mount 20. The detent system 17 included inside the movable frame retainer 14 mates with ratchet teeth 16T included in ratchet arm 16 to anchor the movable frame retainer 14 in a stationary position on the frame 12 to block any substantial movement of the second cabinet-door handgrip 112H and its cabinet door 112 relative to the first cabinet-door handgrip 111H and its cabinet door 111 as shown in FIG. 4.

Figures 7, 8, 9, 10:
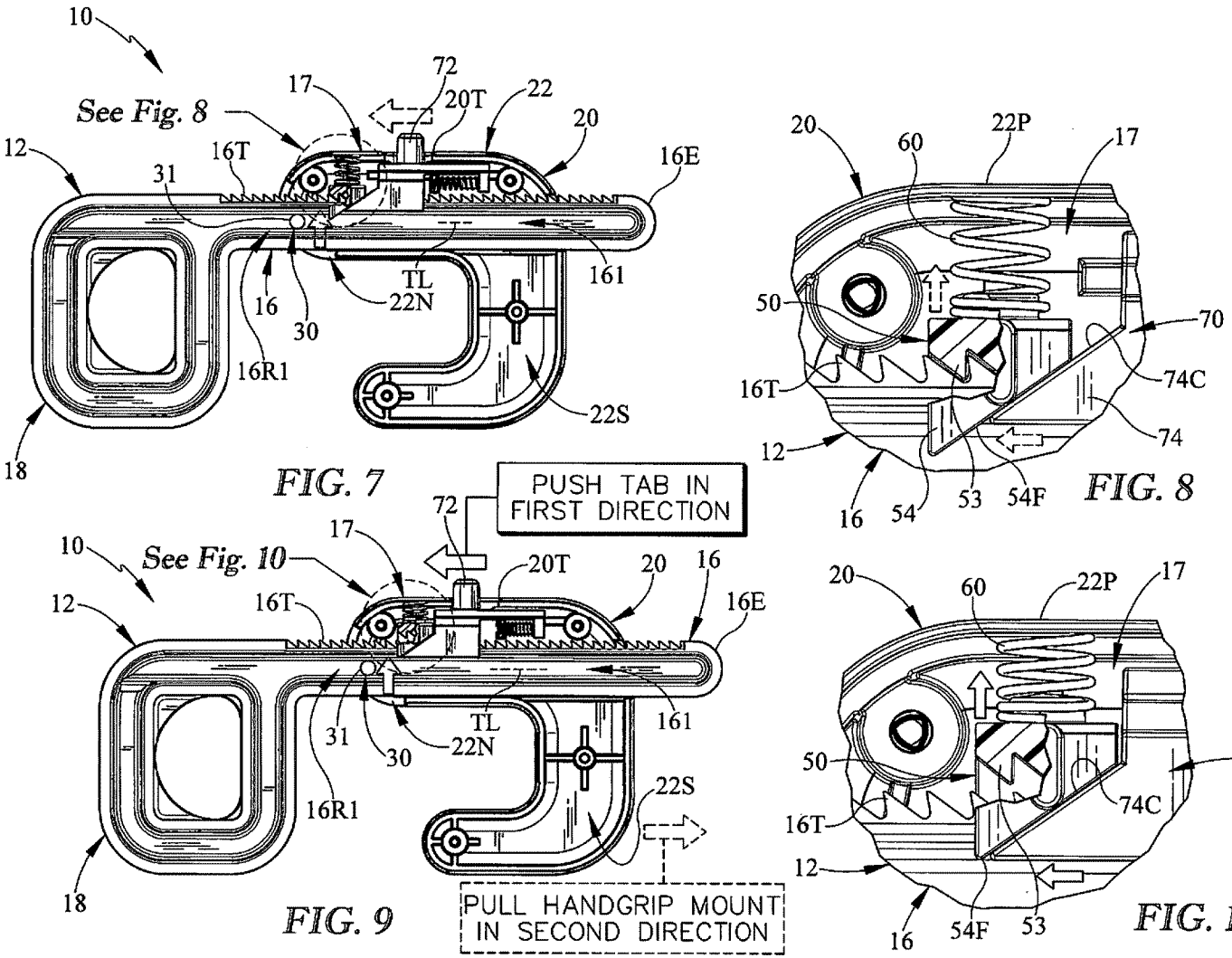
FIG. 7 is a side elevation view of the cabinet lock in a configuration similar to the configuration shown in FIG. 4 with one of the C-shaped handgrip mounts removed to show the components included in the detent system housed in the movable frame retainer and showing when the detent system engages ratchet teeth included in the ratchet arm to lock the movable frame retainer in a stationary position on the ratchet arm of the frame and also showing the placement of the first guide pin that is coupled to the omitted first C-shaped handgrip mount in the first guide slot formed in the ratchet arm.
FIG. 8 is an enlarged view taken from the circled region of FIG. 7 showing spring-biased engagement of two downwardly extending lock teeth included in the detent system with two upwardly extending ratchet teeth included in the ratchet arm.
FIG. 9 is a view similar to FIG. 7 showing disengagement of the detent system that is housed in the movable frame retainer from ratchet teeth included in the ratchet arm to free the movable frame retainer to slide back and forth on the ratchet arm at the option of a caregiver and showing that an exposed lock-release tab is pushed by a caregiver in a first direction toward the closed-loop handgrip mount to release the lock teeth from the ratchet teeth and, while the lock-release tab is pushed, the caregiver pulls the C-shaped handgrip mount in an opposite second direction relative to the ratchet arm.
FIG. 10 is an enlarged view taken from the circled region of FIG. 9 showing upward movement of lock teeth included in the detent system to disengage the underlying ratchet teeth in response to actuation of the lock-release tab by a caregiver.

As suggested in FIG. 7, the movable frame retainer 14 has been slid along the ratchet arm 6 to the right from the position shown in FIG. 9 to cause a first guide pin 31 included in the movable frame retainer 14 to slide in the first guide slot 161 from the position shown in FIG. 9 to an free-end position established at the free end 16E of the ratchet arm 16 to allow a caregiver to pivot the movable frame retainer 14 about the frame-retainer pivot axis 14A as suggested, for example, in FIG. 3.

In illustrative embodiments, one side of cabinet lock 10 has a closed-loop handgrip mount 18 so that cabinet lock 10 will stay attached to one knob 111H or pull when not in use. Frame 12 is made of NYLON material for strength and flexibility. The molded C-shaped handgrip mount 20 slides over the ratchet arm 16 of the cane-shaped frame 12 for adjustment. C-shaped handgrip mount 20 can be pivoted relative to ratchet arm 16 at the free end 16E of ratchet arm 16 without separating from ratchet arm 16 in order to allow cabinet lock 10 to fit over knobs and handles that span a greater distance. The C-shaped handgrip mount can fit over the adjacent knob/handle and can be pushed to tighten both knobs together, holding cabinet doors 111, 112 shut. Lock-release tab 72 can be moved to allow the caregiver to release the C-shaped handgrip mount 20 to release handgrip mount 20 from ratchet teeth 16T of the cane-shaped frame 12 to unlock cabinet lock 10.

Cabinet lock 10 works on adjacent cabinet doors 111, 112 with knobs or handles by holding the knob or handle hardware together. One of the two knobs or handles will be removed from the cabinet door in illustrative embodiments to attach the closed-loop handgrip mount 18 to that knob or handle. Pushing lock-release tab 72 one way and pulling the C-shaped handgrip mount 20 the other way as suggested in FIG. 9 makes cabinet lock 20 difficult to operate for a child but easy to operate for a caregiver. Cabinet lock 10 is adjustable and will work for many different double-door adjacent distances. Cabinet lock 10 will hang from the closed-loop handgrip mount 18 installed behind the knob/handle when the cabinet doors 111, 112 are opened or during periods of non-use of cabinet lock 10. No screw or adhesive is needed to lock cabinet doors 111, 112 to one another.

Figure 14:
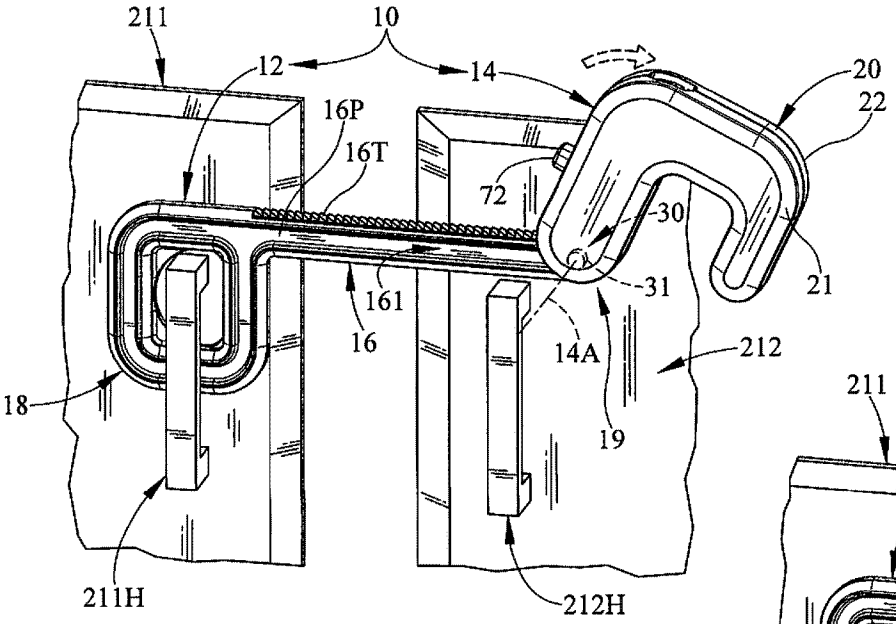
FIGS. 14-16 show the cabinet lock of FIG. 1 during installation on a pair of sliding cabinet doors provided with handles rather than knobs.
Figure 15:
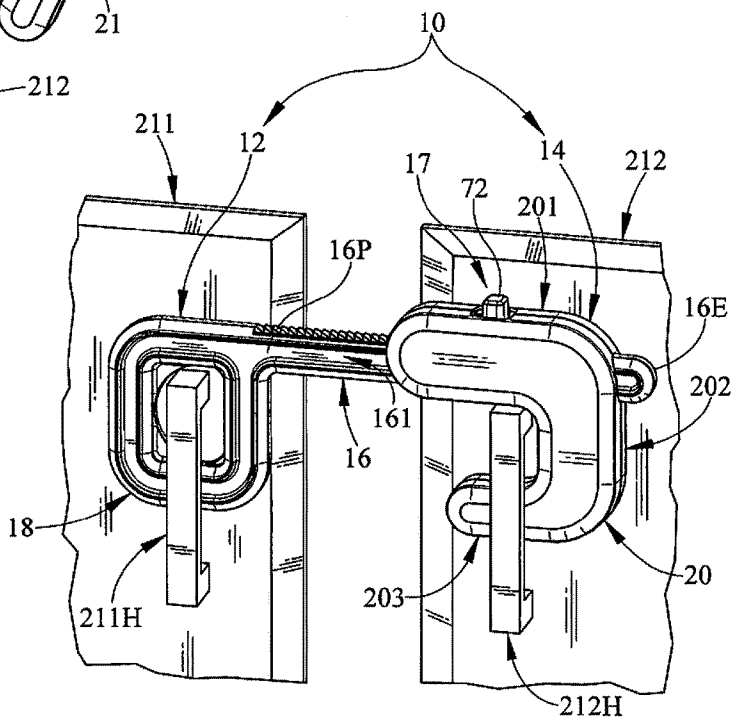
Figure 16:
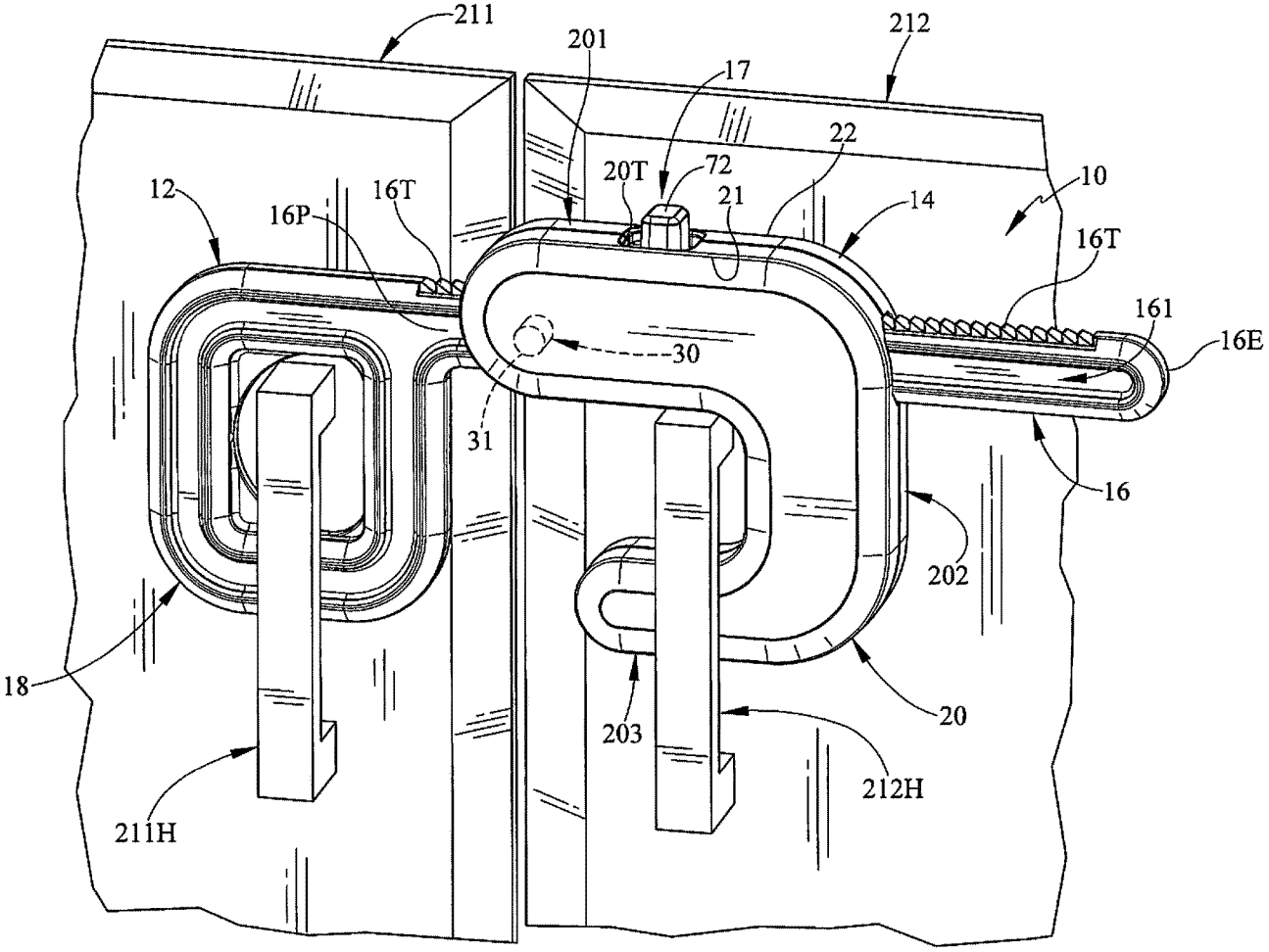

Cabinet lock 10 is shown in FIGS. 14-16 during installation on a pair of sliding cabinet doors provided with handles 211H, 212H rather than knobs. A perspective view of a pair of sliding doors 211, 212 that are separated from one another is provided in FIG. 4. Cabinet lock 10 is shown in FIG. 14 in an orientation similar to that shown in FIG. 3 in which the ratchet arm 16 of the frame 12 lies above a right door handle 212H while the closed-loop handgrip mount 18 of the frame 12 is mounted on a left door handle 211H. As suggested in FIG. 15, the C-shaped handgrip mount 20 of the frame retainer 14 has been pivoted downwardly on the first and second guide pins 31, 32 by a caregiver about the frame-retainer pivot axis 14A and then slid to the left on ratchet arm 16 to cause a portion of the right door handle 212H to extend into the handgrip-receiving channel 20C formed in the C-shaped handgrip mount 20. As suggested in FIG. 16, a caregiver has slid the cabinet doors 211, 212 toward one another until they nearly touch and showing that the detent system 17 has been operated by the caregiver to free the C-shaped handgrip mount 20 of the movable frame retainer 14 to move along the ratchet arm 16 toward the closed-loop handgrip mount 18 of the frame 12 as the cabinet doors 211, 212 are drawn together by the caregiver.

Cabinet lock 10 is provided for a cabinet 110 having relatively movable first and second cabinet doors 111, 112 as suggested in FIGS. 1-4. Cabinet lock 10 includes a frame 12, a movable frame retainer 14, and a detent system 17.

Frame 12 includes a ratchet arm 16 and a first handgrip mount 18 coupled to a first end of the ratchet arm 16 and adapted to be mated with a first handgrip 111H included in the cabinet 110 and coupled to the first cabinet door 111 as suggested in FIGS. 2 and 3. Ratchet arm 16 includes a series of ratchet teeth 16T located between the first end 16P and an opposite second end 16E of the ratchet arm 16 as suggested in FIG. 5.

The movable frame retainer 14 includes a second handgrip mount 20 arranged to slide back and forth along a travel line (TL) on a length of the ratchet arm 16 between the first and second ends 16P, 16E and to pivot about a pivot axis 14A that is perpendicular to the travel line (TL) to be mated with a second handgrip 112 included in the cabinet 110 as suggested in FIGS. 1-3. Second handgrip mount 20 is formed to include a handgrip-receiving channel 20C sized to receive a portion of the second handgrip 112 included in the cabinet 110 when the second handgrip mount 20 is mated with the second handgrip 112H as suggested in FIG. 4.

Detent system 17 is coupled to second handgrip mount 20 for engaging at least one ratchet tooth 161 on the ratchet arm 16 while first handgrip mount 18 is coupled to the first handgrip 111H coupled to the first cabinet door 111 following sliding movement of the second handgrip mount 20 along the travel line (TL) in a direction from the second end 16E toward the first end 16P to locate a portion of the second handgrip 112H in the handgrip-receiving channel 20C formed in the second handgrip mount 20 after the second handgrip mount 20 has pivoted about the pivot axis to assume a second-handgrip-mating orientation wherein the handgrip-receiving channel 20C formed in the second handgrip mount 20 is arranged to open toward the second handgrip 112H coupled to the second cabinet door 112 as suggested in FIGS. 1-3. Thus, movement of the second handgrip mount 20 away from the first handgrip mount 18 is blocked while the first handgrip mount 18 is mated to the first handgrip 111H coupled to the first cabinet door 111 when the first and second cabinet doors 111, 112 are in a closed position to block relative movement of the first and second cabinet doors 111, 112 to opened positions as suggested in FIG. 4.

Ratchet arm 16 includes a first guide slot 161 arranged to extend along the travel line (TL) as suggested in FIG. 5. The movable frame retainer 14 further includes a first guide pin 31 coupled to the second handgrip mount 20 and arranged to extend into and travel back and forth in the first guide slot 161 along the travel line (TL) to support the second handgrip mount 20 for sliding and pivoting movement relative to the ratchet arm 16 during coupling of the movable frame retainer 14 to the second handgrip 112H and uncoupling of the movable frame retainer 14 from the second handgrip 112H.

Detent system 17 is arranged to engage the ratchet teeth 16T on the ratchet arm 16 during sliding movement of the second handgrip mount 20 relative to the ratchet arm 16. First guide pin 31 is arranged to lie along the travel line (TL) and in a position located between first handgrip mount 18 and detent system 17 during back-and-forth sliding movement of second handgrip mount 20 relative to ratchet arm 16.

Detent system 17 is arranged to disengage the ratchet teeth 16T prior to arrival of the movable frame retainer 14 at the second end 16E of the ratchet arm 16 to free the first guide pin 31 to rotate in the first guide slot 161 about the pivot axis during rotation of the second handgrip mount 20 about the pivot axis as suggested in FIGS. 2 and 3 to assume the second-handgrip-mating orientation shown, for example, in FIG. 4.

Second handgrip mount 20 includes a top segment 201 having a free end and an opposite proximal end, a bottom segment 203 having a free end and an opposite proximal end, and a bight segment 202 arranged to interconnect the proximal ends of the top and bottom segments 201, 203 and cooperate with the top and bottom segments 201, 203 to define the handgrip-receiving channel 20C as suggested in FIG. 3. First guide pin 31 is coupled to the free end of the top segment 201. Detent system 17 is coupled to the top segment 201 and arranged to lie between the first guide pin 31 and the proximal end of the top segment 201 as suggested in FIG. 11. The top, bight, and bottom segments 201, 202, 203 cooperate to provide the second handgrip mount 20 with a C-shape as suggested in FIG. 1. Top segment 201 has a first length and the bottom segment 202 has a relatively shorter second length.

First handgrip mount 18 has an endless or nearly endless closed-loop shape and is formed to include opening means for receiving a portion of the first handgrip 111H therein to support the frame 12 for rotation about the first handgrip 111H as suggested in FIGS. 2 and 3 to cause the frame 12 to stay attached to the first handgrip 111H during rotation of the frame 12 out the handgrip 111H to place the ratchet arm 16 on an upward-facing portion of the second handgrip 112H as suggested in FIG. 3 before the second handgrip mount 20 is pivoted about the pivot axis 14A to assume the second-handgrip-mating orientation shown in FIG. 4 so that the second handgrip mount 20 can be moved along the travel line (TL) on the ratchet arm 16 toward the first handgrip mount 18 to cause detent system 17 to engage the at least one ratchet tooth 16T.

Ratchet arm 16 also includes a second guide slot 162 arranged to extend along the travel line (TL) as suggested in FIG. 6. The movable frame retainer 14 further includes a second guide pin 32 coupled to second handgrip mount 20 and arranged to extend into and travel back and forth in the second guide slot 162 along the travel line (TL) also to support second handgrip mount 20 for sliding and pivoting movement relative to ratchet arm 16 during coupling of the movable frame retainer 14 to the second handgrip 112H and uncoupling of the movable frame retainer 14 from the second handgrip 112H.

First guide pin 31 is cantilevered to the second handgrip mount 20 and arranged to extend in a first direction 31D into the first guide slot 161 as suggested in FIG. 5. Second guide pin 32 is cantilevered to the second handgrip mount 20 and arranged to extend in an opposite second direction 32D into the second guide slot 162 to lie in co-axial relation to first guide pin 31 as suggested in FIGS. 6 and 13.

Figure 11:
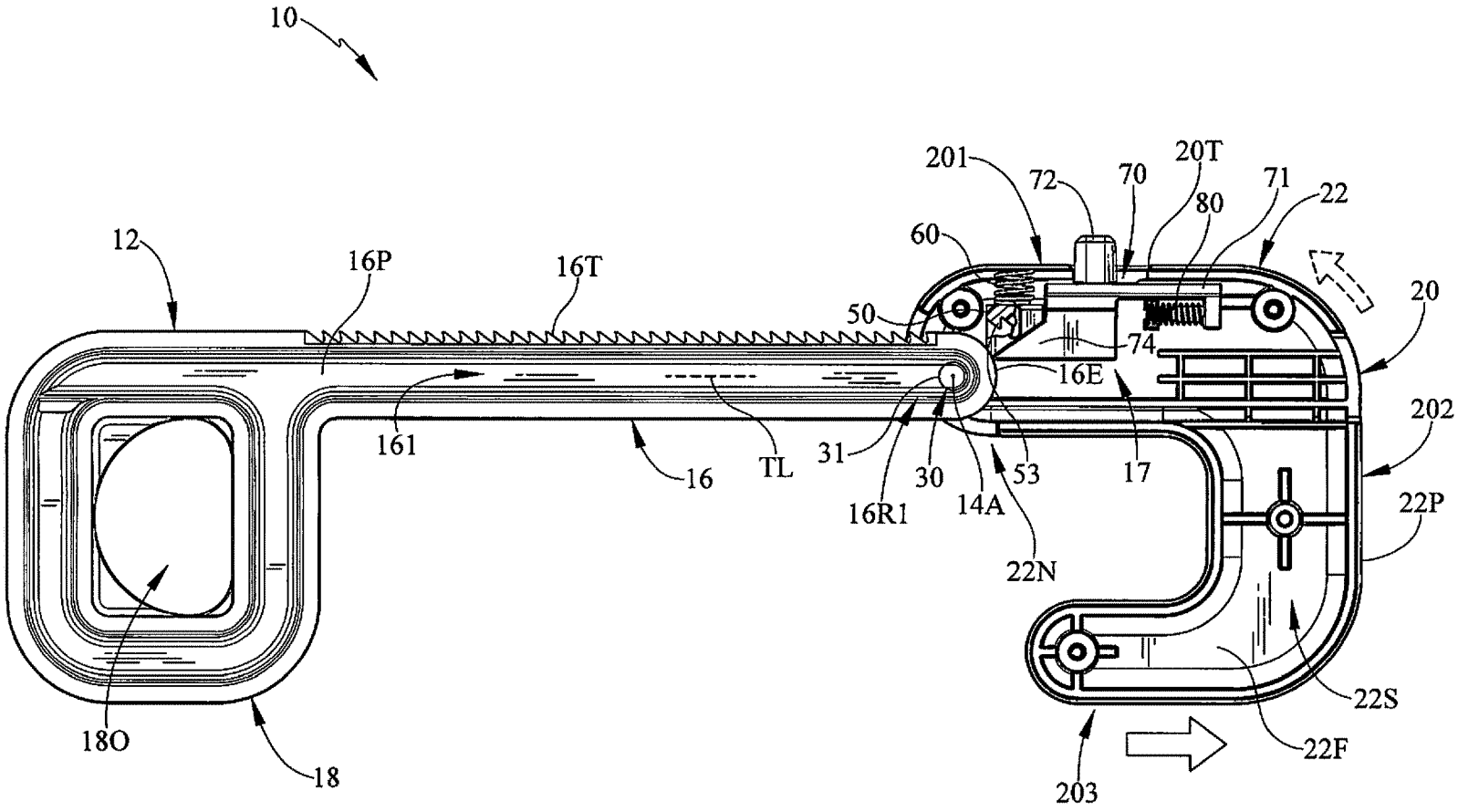
FIG. 11 is an enlarged view similar to FIGS. 7 and 9 showing that the movable frame retainer has been slid along the ratchet arm to the right from the position shown in FIG. 9 by a caregiver to cause a first guide pin included in the movable frame retainer to slide in the first guide slot from the position shown in FIG. 9 to an free-end position established at the free end of the ratchet arm to allow a caregiver to pivot the movable frame retainer about the frame-retainer pivot axis as suggested, for example, in FIG. 3.

Cabinet lock 10 includes a frame 12, a movable frame retainer 14, and a slide-and-pivot system 19 coupled to frame 12 and movable frame retainer 14 as suggested in FIGS. 5, 6, and 11. In illustrative embodiments, slide-and-pivot system 19 comprises a first guide-pin receiver 16R1 coupled to one side of ratchet arm 16 and a first guide in 31 configured and arranged to be received for sliding and pivoting movement in first guide-pin receiver 16R1 as suggested in FIGS. 5, 7, 9, 11, and 13. In illustrative embodiments, slide-and-pivot system 19 also comprises a second guide-pin receiver 16R2 coupled to another side of ratchet arm 16 and a second guide pin 32 configured and arranged to be received for sliding and pivoting movement in second guide-pin receiver 16R2 as suggested in FIGS. 6 and 13.

Frame 12 is cane-shaped in an illustrative embodiment as suggested in FIG. 1. Frame 12 includes a closed-loop handgrip mount 18 formed to include a handgrip-receiving opening 18O adapted to receive a portion of the first handgrip 111H therein and a ratchet arm 16 cantilevered to the closed-loop handgrip mount 18. Ratchet arm 16 has a proximal end 16P coupled to the closed-loop handgrip mount 18 and an opposite free end 16E arranged to lie in spaced-apart relation to the proximal end 16P. Although closed-loop handgrip mount 18 is endless in illustrative embodiments, it is within the scope of the present disclosure to provide a nearly endless closed-loop handgrip mount that will remain mated with first handgrip 111H during rotation of frame 12 about first handgrip 111H as suggested in FIGS. 2 and 3.

The movable frame retainer 14 includes a C-shaped handgrip mount 20 as suggested in FIG. 1. C-shaped handgrip mount 20 is formed to include a second-handgrip-receiving channel 20C adapted to receive a portion of the second handgrip 112H therein as suggested in FIG. 4.

Slide-and-pivot system 19 is provided for supporting the C-shaped handgrip mount 20 (1) to slide on the ratchet arm 16 along a line of travel (TL) from the proximal end 16P to the free end 16E (and back) and (2) to pivot about a pivot axis 14A that is substantially perpendicular to the line of travel (TL) as suggested in FIGS. 1-3. Thus, the C-shaped handgrip mount 20 can be moved relative to the ratchet arm 16 to cause a portion of the second handgrip 112H to extend into the handgrip-receiving channel 20C while the first handgrip 111H is arranged to extend into the handgrip-receiving opening 18O formed in the closed-loop handgrip mount 18 as suggested in FIG. 4.

The slide-and-pivot system 19 includes a first guide pin 31 coupled to the C-shaped handgrip mount 20 to move therewith and a first guide-pin receiver 16R1 coupled to the ratchet arm 16 to move therewith as suggested in FIG. 5. First guide-pin receiver 16R1 is arranged to mate with the first guide pin 31 during sliding and pivoting movement of the C-shaped handgrip mount 20 along the line of travel (TL) associated with the ratchet arm 16 as suggested in FIG. 5.

The first guide-pin receiver 16R1 is coupled to one side of ratchet arm 16 and includes a downwardly facing upper wall 16U1 and an upwardly facing bottom wall 16B1 that is arranged to lie in spaced-apart relation to the downwardly facing upper wall 16U1 along the travel line (IL) to define a first guide slot 161 therebetween as suggested in FIG. 5. The first guide-pin receiver 16R1 also includes a pin-blocker wall 16W1 arranged to lie at the free end 16E of the ratchet arm 16 to block removal of the first guide pin 31 from the first guide slot 161 at the free end 16E of the ratchet arm 16. Pin-blocker wall 16W1 is arranged to interconnect the downwardly facing upper wall 16U1 and the upwardly facing bottom wall 16B1.

The second guide-pin receiver 16R2 is similar to the first guide-pin receiver 16R1 as can be seen in FIGS. 5, 6, and 13. The second guide-pin receiver 16R2 is coupled to an opposite side of ratchet arm 16 and comprises a downwardly facing upper wall 16U2, an upwardly facing bottom wall 16B1, and a pin-blocker wall 16W2 as suggested in FIG. 6.

Ratchet arm 16 is formed to include a series of upwardly extending ratchet teeth 16T arranged to mate with a detent system 17 included in the movable frame member 14 and coupled to the C-shaped handgrip mount 20 as suggested in FIGS. 5-10. Detent system 17 is configured to engage at least one of the ratchet teeth 16T during sliding movement of the C-shaped handgrip mount 20 along the line of travel. The downwardly facing upper wall 16U1 is arranged to lie and extend between the series of upwardly extending ratchet teeth 16T and the upwardly facing bottom wall 16B1.

First guide pin 31 is arranged to lie between the closed-loop handgrip mount 18 and the detent system 17 during sliding movement of the C-shaped handgrip mount 20 as suggested in FIGS. 7 and 9. Detent system 17 is arranged to disengage the series of upwardly extending ratchet teeth 16T prior to arrival of the C-shaped handgrip mount 20 at the free end 16E of the ratchet arm 16 to allow pivotable movement of the C-shaped handgrip mount 20 about the pivot axis relative to the ratchet arm 16 to assume a second-handgrip-mating orientation shown, for example, in FIG. 14 wherein the portion of the second handgrip 112H is arranged to be inserted into the second-handgrip-receiving channel 20C formed in the C-shaped handgrip mount 20 during sliding movement of the C-shaped handgrip mount 20 along the travel line (TL) toward the closed-loop handgrip mount 18. Detent system 17 is arranged to lie in spaced-apart relation to the closed-loop handgrip mount 18 during sliding movement of the C-shaped handgrip mount 20 along the line of travel (TL) to locate the first guide pin 31 between the closed-loop handgrip mount 20 and detent system 17.

Detent system 17 includes a spring-biased, tooth-engaging anchor that is mounted for movement relative to the ratchet arm 16. Anchor is arranged normally to engage underlying ratchet teeth 16T to retain the movable frame retainer 14 in a position on the ratchet arm 16 that has been selected by a user. Detent system 17 also includes a slidable lock-release tab mounted for movement relative to the C-shaped handgrip mount 20 to move the tooth-engaging anchor to disengage ratchet teeth 16T on the ratchet arm 16 to free the C-shaped handgrip mount 20 for movement relative to the ratchet arm 16.

The invention claimed is:

1. A cabinet lock for a cabinet having relatively movable first and second cabinet doors, the cabinet lock comprising a frame including a ratchet arm and a first handgrip mount adapted to be mated with a first handgrip included in the cabinet and coupled to the first cabinet door, the ratchet arm including a series of ratchet teeth located between the first end and an opposite second end of the ratchet arm, a movable frame retainer including a second handgrip mount arranged to slide back and forth along a travel line on a length of the ratchet arm between the first and second ends and to pivot about a pivot axis that is perpendicular to the travel line to be mated with a second handgrip included in the cabinet, the second handgrip mount being formed to include a handgrip-receiving channel sized to receive a portion of the second handgrip included in the cabinet when the second handgrip mount is mated with the second handgrip, and detent means coupled to the second handgrip mount for engaging at least one ratchet tooth on the ratchet arm while the first handgrip mount is coupled to the first handgrip coupled to the first cabinet door following sliding movement of the second handgrip mount along the travel line in a direction from the second end toward the first end to locate a portion of the second handgrip in the handgrip-receiving channel formed in the second handgrip mount after the second handgrip mount has pivoted about the pivot axis to assume a second-handgrip-mating orientation wherein the handgrip-receiving channel formed in the second handgrip mount is arranged to open toward the second handgrip coupled to the second cabinet door so that movement of the second handgrip mount away from the first handgrip mount is blocked while the first handgrip mount is mated to the first handgrip coupled to the first cabinet door when the first and second cabinet doors are in a closed position to block relative movement of the first and second cabinet doors to opened positions, wherein the ratchet arm includes a first guide slot arranged to extend along the travel line and the movable frame retainer further includes a first guide pin coupled to the second handgrip mount and arranged to extend into and travel back and forth in the first guide slot along the travel line to support the second handgrip mount for sliding and pivoting movement relative to the ratchet arm during coupling of the movable frame retainer to the second handgrip and uncoupling of the movable frame retainer from the second handgrip, wherein the second handgrip mount includes a top segment having a free end and an opposite proximal end, a bottom segment having a free end and an opposite proximal end, and a bight segment arranged to interconnect the proximal ends of the top and bottom segments and cooperate with the top and bottom segments to define the handgrip-receiving channel, the first guide pin is coupled to the free end of the top segment, and the detent means is coupled to the top segment and arranged to lie between the first guide pin and the proximal end of the top segment, wherein the top, bight, and bottom segments cooperate to provide the second handgrip mount with a C-shape, wherein the first handgrip mount has a closed-loop shape and is formed to include opening means for receiving a portion of the first handgrip therein to support the frame for rotation about the first handgrip to cause the frame to stay attached to the first handgrip during rotation of the frame about the handgrip to place the ratchet arm on an upward-facing portion of the second handgrip before the second handgrip mount is pivoted about the pivot axis to assume the second-handgrip-mating orientation so that the second handgrip mount can be moved along the travel line on the ratchet arm toward the first handgrip mount to cause the detent means to engage the at least one ratchet tooth.

2. The cabinet lock of claim 1, wherein the detent means is arranged to engage the ratchet teeth on the ratchet arm during sliding movement of the second handgrip mount relative to the ratchet arm and the first guide pin is arranged to lie along the travel line and in a position located between the first handgrip mount and the detent means during back-and-forth sliding movement of the second handgrip mount relative to the ratchet arm.

3. The cabinet lock of claim 2, wherein the detent means is arranged to disengage the ratchet teeth prior to arrival of the movable frame retainer at the second end of the ratchet arm to free the first guide pin to rotate in the first guide slot about the pivot axis during rotation of the second handgrip mount about the pivot axis to assume the second-handgrip-mating orientation.

4. The cabinet lock of claim 1, wherein the ratchet arm also includes a second guide slot arranged to extend along the travel line and the movable frame retainer further includes a second guide pin coupled to the second handgrip mount and arranged to extend into and travel back and forth in the second guide slot along the travel line also to support the second handgrip mount for sliding and pivoting movement relative to the ratchet arm during coupling of the movable frame retainer to the second handgrip and uncoupling of the movable frame retainer from the second handgrip.

5. The cabinet lock of claim 4, where the first guide pin is cantilevered to the second handgrip mount and arranged to extend in a first direction into the first guide slot and the second guide pin is cantilevered to the second handgrip mount and arranged to extend in an opposite second direction into the second guide slot to lie in co-axial relation to the first guide pin.

6. A cabinet lock for a cabinet having relatively movable first and second cabinet doors, a first handgrip coupled to the first cabinet door, and a second handgrip coupled to the second cabinet door to lie in close proximity to the first handgrip when the first and second cabinet doors are closed to block access to an interior region formed in the cabinet, the cabinet lock comprising a frame including a closed-loop handgrip mount formed to include a handgrip-receiving opening adapted to receive a portion of the first handgrip therein and a ratchet arm cantilevered to the closed-loop handgrip mount, the ratchet arm having a proximal end coupled to the closed-loop handgrip mount and an opposite free end arranged to lie in spaced-apart relation to the proximal end, a movable frame retainer including a C-shaped handgrip mount formed to include a second-handgrip-receiving channel adapted to receive a portion of the second handgrip therein, and slide-and-pivot means for supporting the C-shaped handgrip mount to slide on the ratchet arm along a line of travel from the proximal end to the free end and to pivot about a pivot axis that is substantially perpendicular to the line of travel so that the C-shaped handgrip mount can be moved relative to the ratchet arm to cause a portion of the second handgrip to extend into the handgrip-receiving channel while the first handgrip is arranged to extend into the handgrip-receiving opening formed in the closed-loop handgrip mount.

7. The cabinet lock of claim 6, wherein the slide-and-pivot means includes a first guide pin coupled to the C-shaped handgrip mount to move therewith and a first guide-pin receiver coupled to the ratchet arm to move therewith and arranged to mate with the first guide pin during sliding and pivoting movement of the C-shaped handgrip mount along the line of travel associated with the ratchet arm.

8. The cabinet lock of claim 7, wherein the first guide-pin receiver includes a downwardly facing upper wall and an upwardly facing bottom wall that is arranged to lie in spaced-apart relation to the downwardly facing upper wall along the travel line to define a first guide slot therebetween.

9. The cabinet lock of claim 8, wherein the first guide-pin receiver includes a pin-blocker wall arranged to lie at the free end of the ratchet arm to block removal of the first guide pin from the first guide slot at the free end of the ratchet arm.

10. The cabinet lock of claim 9, wherein the pin-blocker wall is arranged to interconnect the downwardly facing upper wall and the upwardly facing bottom wall.

11. The cabinet lock of claim 8, wherein the ratchet arm is formed to include a series of upwardly extending ratchet teeth arranged to mate with a detent system included in the movable frame member and coupled to the C-shaped handgrip mount and configured to engage at least one of the ratchet teeth during sliding movement of the C-shaped handgrip mount along the line of travel and the downwardly facing upper wall is arranged to lie and extend between the series of upwardly extending ratchet teeth and the upwardly facing bottom wall.

12. The cabinet lock of claim 11, wherein the first guide pin is arranged to lie between the closed-loop handgrip mount and the detent system during sliding movement of the C-shaped handgrip mount and the detent system is arranged to disengage the series of upwardly extending ratchet teeth prior to arrival of the C-shaped handgrip mount at the free end of the ratchet arm to allow pivotable movement of the C-shaped handgrip mount about the pivot axis relative to the ratchet arm to assume a second-handgrip-mating orientation wherein the portion of the second handgrip is arranged to be inserted into the second-handgrip-receiving channel formed in the C-shaped handgrip mount during sliding movement of the C-shaped handgrip mount along the travel line toward the closed-loop handgrip mount.

13. The cabinet lock of claim 11, wherein the detent system is arranged to lie in spaced-apart relation to the closed-loop handgrip mount during sliding movement of the C-shaped handgrip mount along the line of travel to locate the first guide pin between the closed-loop handgrip mount and the detent system.

14. The cabinet lock of claim 7, wherein the C-shaped handgrip mount includes a top segment having a free end and an opposite proximal end, a bottom segment having a free end and an opposite proximal end, and a bight segment arranged to interconnect the proximal ends of the top and bottom segments and cooperate with the top and bottom segments to define the second-handgrip-receiving channel, the first guide pin is coupled to the free end of the top segment, and the detent system is coupled to the top segment and arranged to lie between the first guide pin and the proximal end of the top segment.

15. The cabinet lock of claim 14, wherein the top segment has a first length and the bottom segment has a relatively shorter second length.

16. The cabinet lock of claim 14, wherein the detent system includes a spring-biased, tooth-engaging anchor that is mounted for movement relative to the ratchet arm and is arranged normally to engage underlying ratchet teeth to retain the movable frame retainer in a position on the ratchet arm that has been selected by a user and the detent system also includes a slidable lock-release tab mounted for movement relative to the C-shaped handgrip mount to move the tooth-engaging anchor to disengage ratchet teeth on the ratchet arm to free the C-shaped handgrip mount for movement relative to the ratchet arm.

17. The cabinet lock of claim 7, wherein the C-shaped handgrip mount includes separate first and second C-shaped shells that are mated to one another to locate the detent system and a portion of the ratchet arm therebetween.

18. The cabinet lock of claim 17, wherein the first C-shaped shell is formed to include an arm-receiving notch aligned in close proximity to the first guide pin and formed to receive a portion of the ratchet arm therein during pivoting movement of the C-shaped handgrip mount about the pivot axis.

19. The cabinet lock of claim 18, wherein the first C-shaped shell includes a front wall having a perimeter edge and perimeter wall coupled to the perimeter edge of the front wall, the first guide pin is coupled to the front wall, and the perimeter wall is formed to include the arm-receiving notch.

* * * * *